US006083019A

United States Patent [19]

Yu et al.

[11] Patent Number: 6,083,019

[45] Date of Patent: Jul. 4, 2000

[54] ELECTRONIC CARD CONNECTOR

[75] Inventors: Hung-Chi Yu, Hsi-Chih, Taiwan; Tomohisa Hara, Nagono, Japan

[73] Assignee: Hon Hai Precision Ind. Co., Ltd., Taipei Hsien, Taiwan

[21] Appl. No.: 09/348,748

[22] Filed: Jul. 6, 1999

[30] Foreign Application Priority Data

Dec. 28, 1998 [TW] Taiwan ..... 87221638

[51] Int. Cl.[7] ..... H01R 13/62

[52] U.S. Cl. ..... 439/159

[58] Field of Search ..... 439/152–157, 439/159, 160

[56] References Cited

U.S. PATENT DOCUMENTS 5,451,168 9/1995 Shuey ..... 439/159

*Primary Examiner*—Gary F. Paumen

*Attorney, Agent, or Firm*—Wei Te Chung

[57] ABSTRACT

An electronic card connector includes an insulative header retaining contact elements therein and a shielding member attached to the header for electrically engaging with an electronic card received in the connector. The shielding member forms a pivot thereon for rotatably supporting a rocking member which is rotated by a manually-operated bar for drivingly engaging with and ejecting the electronic card out of the connector. A retaining tab is formed on the pivot and is shaped to be unsymmetrical about a center of the pivot thereby having a maximum dimension in a first direction. An opening is defined in the rocking member for receiving the retaining tab. The widest portion of the opening substantially corresponds to the maximum dimension of the retaining tab whereby the retaining tab is received in the opening when the maximum dimension is aligned with the widest portion. The maximum dimension of the retaining tab engages with the opening when it is not aligned with the widest portion of the opening thereby retaining the rocking member on the shielding member.

13 Claims, 5 Drawing Sheets

ELECTRONIC CARD CONNECTOR

BACKGROUND OF THE INVENTION

1. Field of the Invention

The present invention generally relates to an electronic card connector, and in particular to an easily assembled electronic card connector.

2. The Prior Art

Electronic cards, such as PCMCIA cards and memory cards, are widely used for expanding resources of a computer. The electronic card is releasably connected to a main computer board by an electronic card connector. The electronic card connector includes a card release mechanism for releasing the electronic card therefrom. The card release mechanism comprises a rocking member having a first end coupled to a manually-operated bar which when actuated rotates the rocking member about a fixed pivot. An opposite second end of the rocking member engaged with the electronic card drives the card out of the connector. Examples of such card release mechanisms are disclosed in Taiwan Patent Application Nos. 83215619 and 84210015.

FIG. 5 of the attached drawings shows a pivotal connection of a rocking member 8 of a conventional electronic card connector. A hollow cylinder 71 is formed on a shielding member 7. The cylinder 71 is inserted into a circular hole 81 of the rocking member 8 for rotatably supporting the rocking member 8. A free end of the cylinder 71 is expanded to form a flange 72 for retaining the rocking member 8 on the shielding member 7.

FIG. 6 shows a pivotal connection of a rocking member 80 of another conventional electronic card connector. A cylindrical projection 91 of an insulative header 9 of the electronic card connector extends through a circular hole 82 of the rocking member 80 thereby rotatably supporting the rocking member 80. A free end of the projection 91 is then deformed for retaining the rocking member thereon.

The conventional designs require the pivot to be deformed after the rocking member is fit thereon thereby complicating manufacture of the electronic card connector and increasing costs.

Thus, it is desired to provide an electronic card connector that eliminates the problem discussed above.

SUMMARY OF THE INVENTION

Accordingly, an object of the present invention is to provide an electronic card connector comprising a rocking member pivotally mounted to the connector.

Another object of the present invention is to provide an electronic card connector comprising a rocking member securely mounted thereto for effectively releasing an electronic card from the connector.

To achieve the above objects, an electronic card connector in accordance with the present invention comprises an insulative header retaining contact elements therein and a shielding member attached to the header for electrically engaging with an electronic card received in the connector. The shielding member forms a pivot thereon for rotatably supporting a rocking member which is rotated by a manually-operated bar for drivingly engaging with and ejecting the electronic card out of the connector. A retaining tab is formed on the pivot and is shaped to be unsymmetrical about a center of the pivot thereby having a maximum dimension in a first direction. An opening is defined in the rocking member for receiving the retaining tab. The widest portion of the substantially corresponds to the maximum dimension of the retaining tab whereby the retaining tab is received in the opening when the maximum dimension is aligned with the widest portion. The maximum dimension of the retaining tab engages with the opening when it is not aligned with the widest portion of the opening thereby retaining the rocking member on the shielding member.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figures 1, 1A:
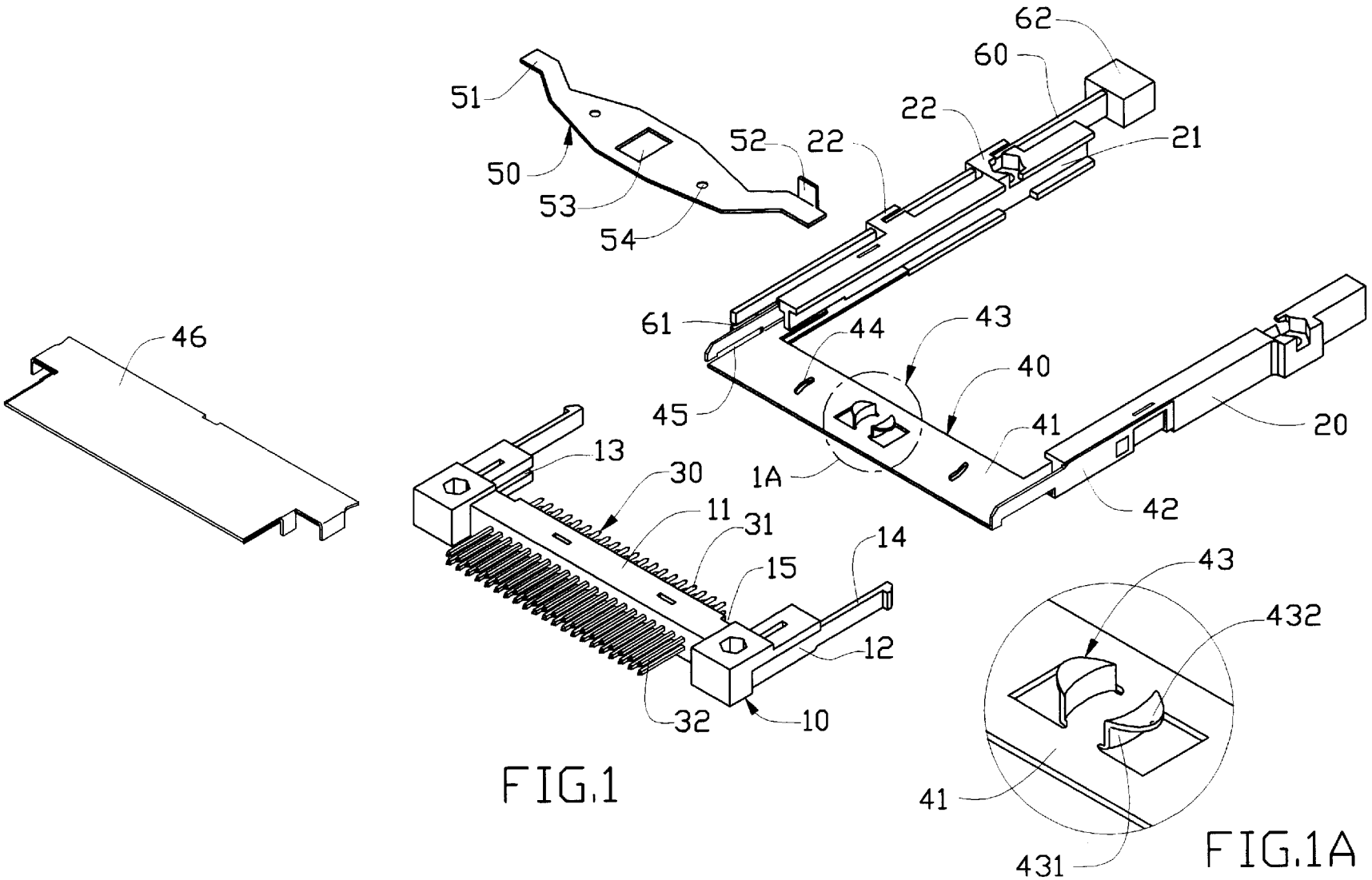
FIG. 1 is an exploded view of an electronic card connector constructed in accordance with the present invention.
FIG. 1A is an enlarged view of the encircled portion 1A of FIG. 1.

Referring to the drawings and in particular to FIG. 1, an electronic card connector in accordance with the present invention comprises a U-shaped insulative header 10 comprising a central section 11 and two arms 12 extending from opposite ends thereof thereby defining a space for receiving an electronic card (not shown). Each arm 12 defines a guide slot 13 on an inside face thereof for guiding the electronic card into the connector. A plurality of contact elements 30 is retained in the central section 11. Each contact element 30 has a mating end 31 and a mounting end 32 extending beyond the header 10 in opposite directions for electrically engaging with the electronic card and electrically connecting to a circuit board (not shown), respectively.

Each arm 12 of the header 10 has a barbed end section 14 for engaging with and being retained in a corresponding elongate guide rail 20. Each guide rail 20 defines a channel 21 in an inside face thereof for guiding the electronic card into the guide slot 13 of the corresponding arm 12.

A card release mechanism (not labeled) is assembled to the header 10 for ejecting the electronic card from the connector. The card release mechanism comprises a card release bar 60 movably supported by bar support members 22 formed on an outside face of one of the guide rails 20. Each bar support member 22 defines a bore (not labeled) for movably receiving the card release bar 60 therein. The bar 60 defines a recess 61 in an inner end thereof and forms a push button 62 on an outer end which is accessible and depressible by a user for actuating the card release bar 60.

A shielding member 40 comprises a central panel 41 mounted to a first face of the central section 11 of the header 11 and two side extensions 42 secured to the two guide rails 20 thereby securing the guide rails 20 to the header 10. A support device 43 is formed on the central panel 41 of the shielding member 40 for rotatably supporting an elongate rocking member 50 about a pivot. The support device 43 includes a retaining tab (not labeled) for retaining the rocking member 50. The retaining tab is unsymmetrical about a center of the pivot and is preferably elongate in a direction substantially parallel to the central panel 41 of the header 40.

Figure 2:
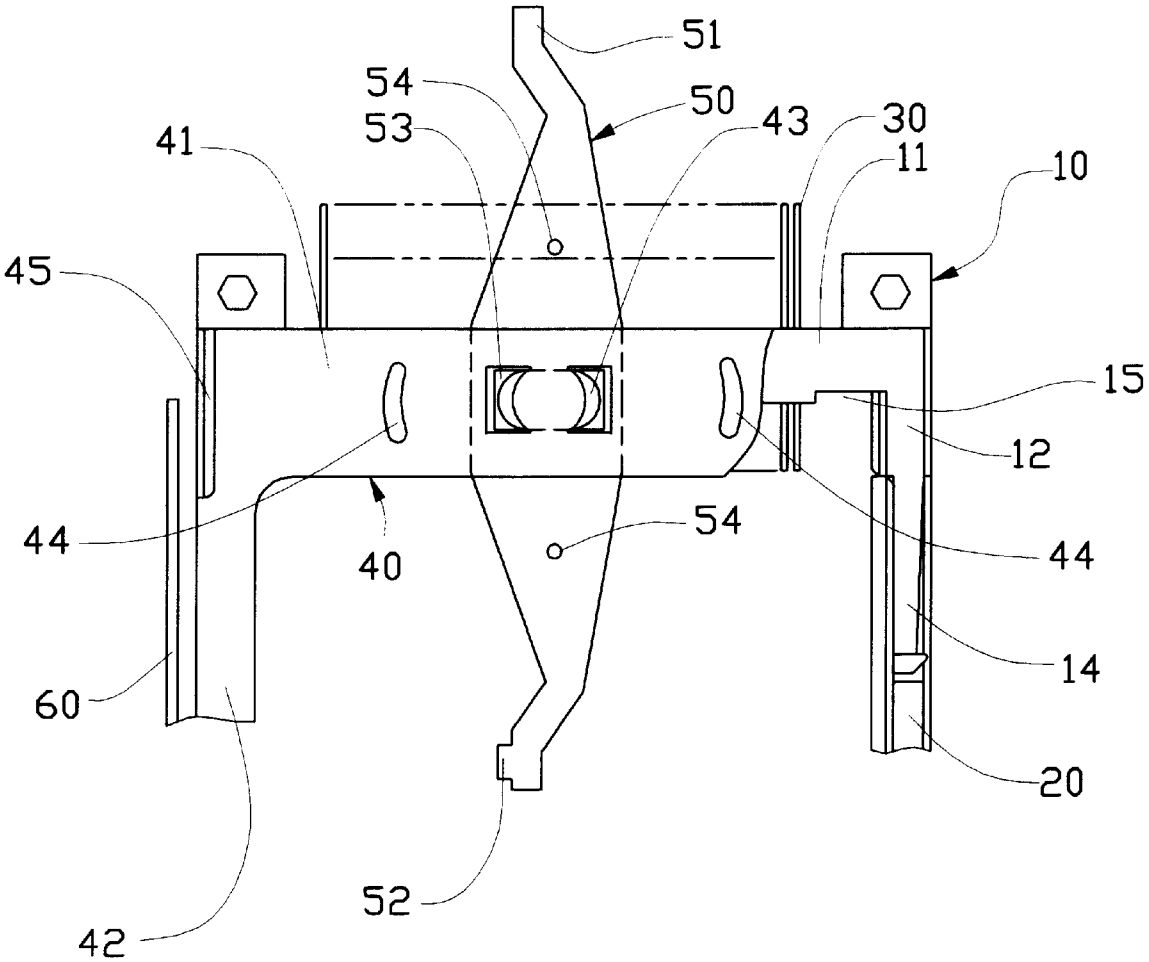
FIG. 2 is a top plan view of the electronic card connector showing a rocking member thereof located at a normal position with respect to a shielding member of the connector.
Figure 3:
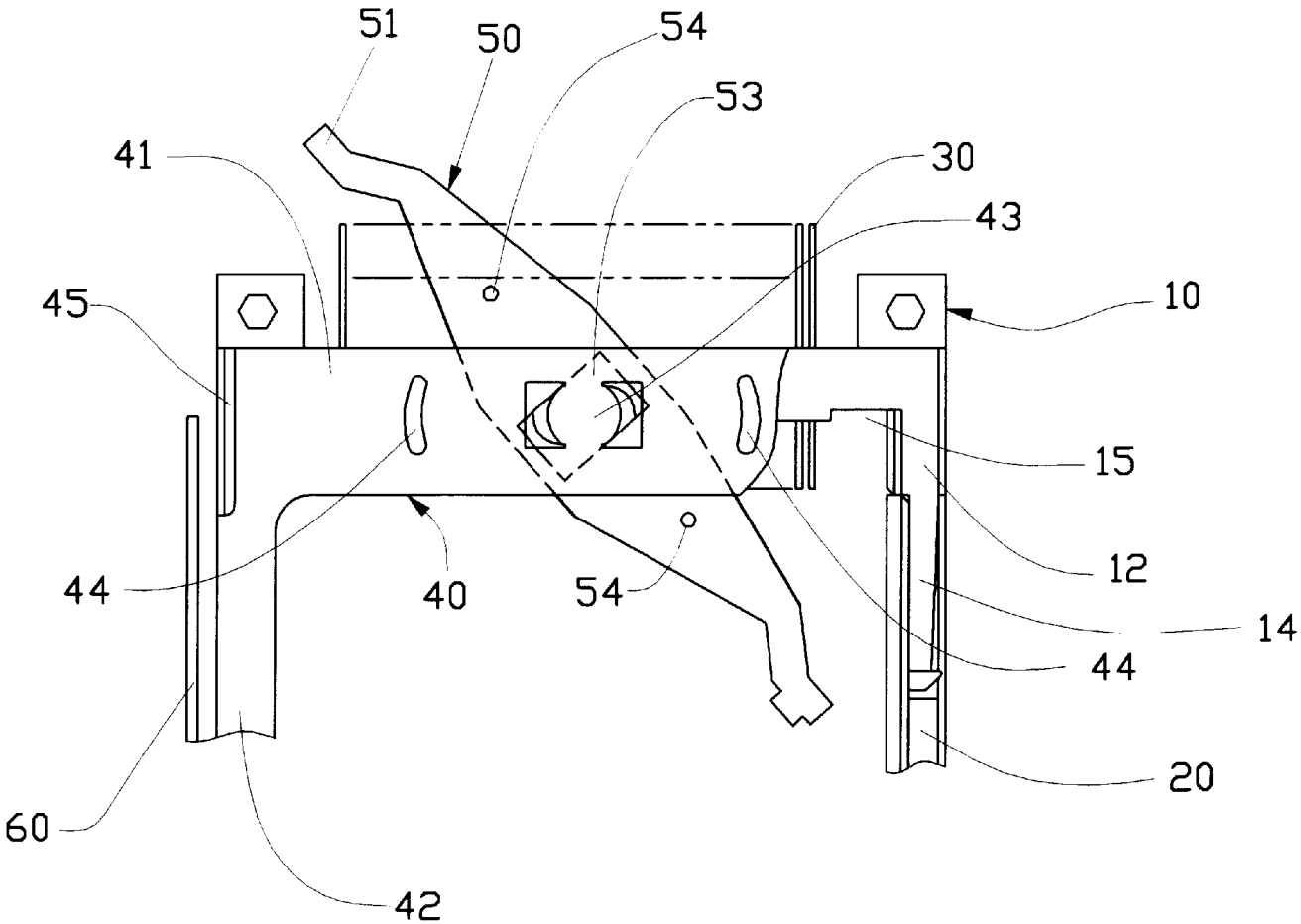
FIG. 3 is a top plan view similar to FIG. 2 but showing the rocking member located at an intermediate position.

As shown in FIG. 1A, in the embodiment illustrated, the support device 43 comprises two arcuate projections 431 co-axial with the center of the pivot for rotatably engaging with a rectangular opening 53 defined in the rocking member 50. Preferably, the arcuate projections 431 are stamped on the central panel 41 of the shielding member 40. A flange 432 transversely extends from each arcuate projection 431. In the embodiment illustrated, each flange 432 has a crescent shape whereby both flanges 432 together form portions of an ellipse having a minor axial length and a major axial length respectively corresponding to the length and width of the rectangular opening 53 of the rocking member 50 whereby when the rocking member 50 is substantially normal to the central panel 41 of the shielding member 40 as shown in FIG. 2, the retaining tab of the support device 43 is receivable in the rectangular opening 53 of the rocking member 50. By rotating the rocking member 50 about the pivot of the support device 43 from the normal position shown in FIG. 2 and past an intermediate position shown in FIG. 3, to a substantially parallel position shown in FIG. 4, the rocking member 50 is retained on the shielding member 40 due to the flanges 432 of the support device 43.

The opening 53 may have an elliptical shape substantially corresponding to the flanges 432 for receiving the support device 43. Alternatively, the flanges 432 may together form a rectangular shape substantially corresponding to the rectangular opening 53 of the rocking member 50.

The rocking member 50 forms two guide pins 54 movably received in arcuate slots 44 defined in the central section 41 of the shielding member 40 and co-axial with the pivot of the support device 43 for guiding the rotation of the rocking member 50 with respect to the shielding member 40 about the support device 43. The arcuate slots 44 have a predetermined length which limits the rotation of the rocking member 50 within a predetermined angular stroke.

Figure 4:
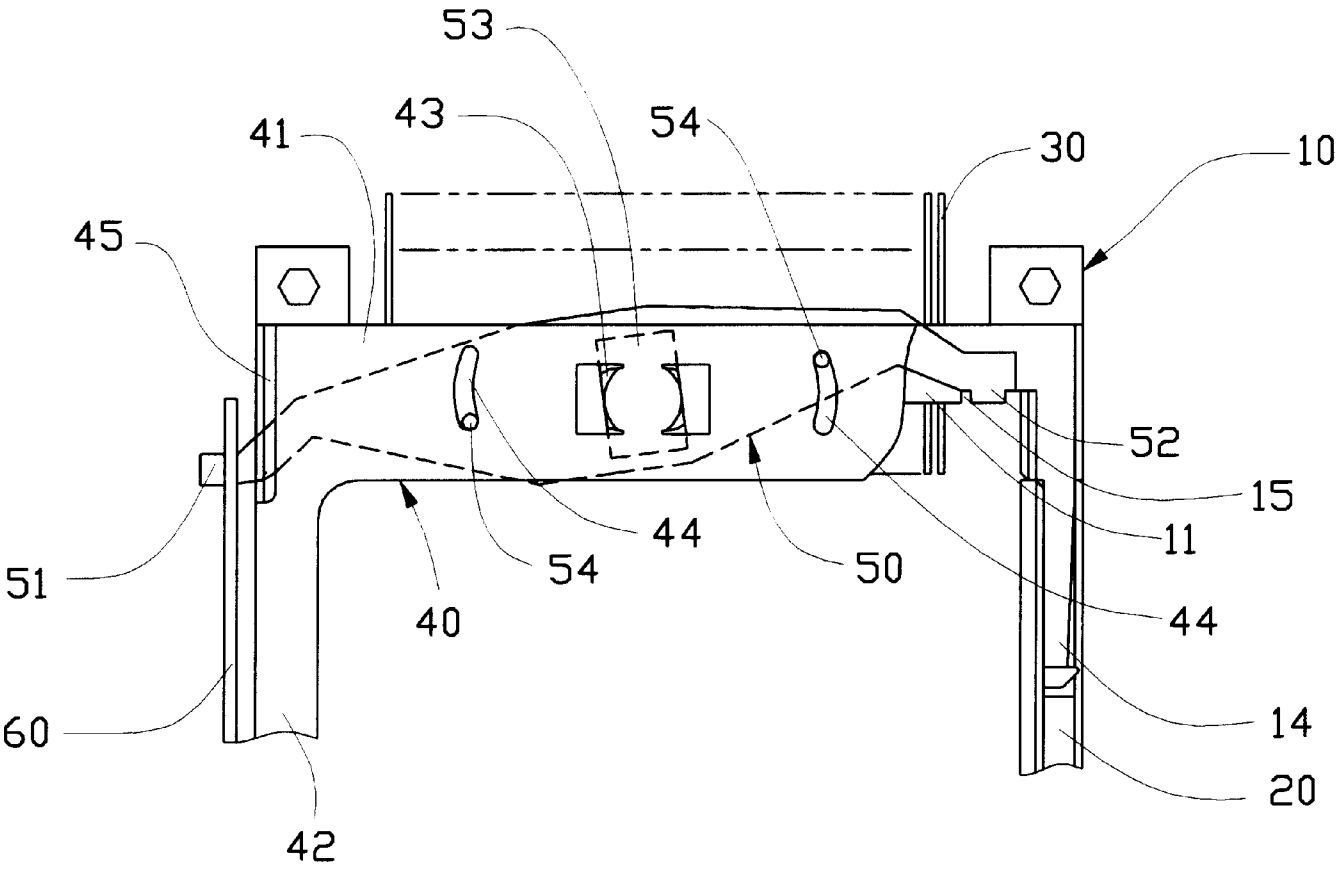
FIG. 4 is a top plan view similar to FIGS. 2 but showing the rocking member located at a parallel position.
Figure 5:
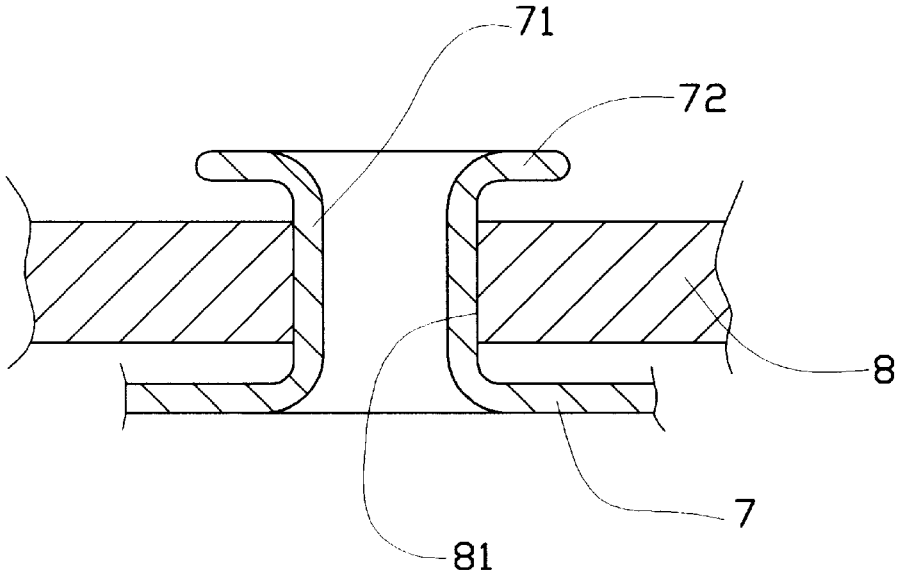
FIG.5 PRIOR ART
FIG. 5 is a partial cross-sectional view of a conventional electronic card connector.
Figure 6:
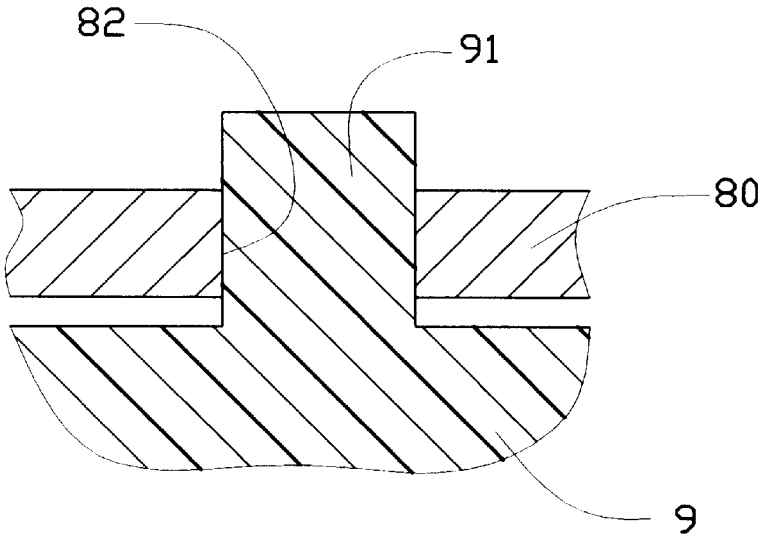
FIG.6 PRIOR ART
FIG. 6 is a partial cross-sectional view of another conventional electronic card connector.

As shown in FIG. 4, an end 51 of the rocking member 50 extends beyond the shielding member 40 via a slot 45 defined in the corresponding extension 42 of the shielding member 40 when the rocking member 50 is at the parallel position. To receive the end 51 in the slot 45 when the rocking member 50 is rotated from the normal position to the parallel position, the slot 45 is exposed to an edge of the shielding member 40 as shown in FIG. 1. The end 51 is movably received in and engages with the recess 61 of the bar 60 whereby when the push button 62 of the bar 60 is depressed, the engagement between the end 51 of the rocking member 50 and the recess 61 of the bar 60 causes the rocking member 50 to rotate about the support device 43.

A card engaging tab 52 is formed on an opposite end of the rocking member 50 whereby when the rocking member 50 is rotated by depressing the push button 62 of the bar 60, the card engaging tab 52 drivingly engages with and forces the electronic card outwardly. The card engaging tab 52 is located between the arms 12 of the header 10 and is receivable in a recess 15 defined in the central section 11 thereby not interfering with the electronic card inserted into the connector. A second shielding member 46 is attached to a second face of the central section 11 of the header 10.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electronic card connector comprising:

an insulative header comprising a central section and two arms extending from opposite ends thereof thereby defining a space adapted to receive an electronic card;

contact elements retained in the central section of the header and extending into the space for electrically engaging with the electronic card;

a card release mechanism comprising a shielding member attached to a first face of the central section of the header, a pivot having a center being formed on the shielding member for rotatably supporting a rocking member thereon, the rocking member comprising a first end coupled to a manually-operated bar for being driven thereby to rotate generally about the pivot and a second end drivingly engaging with and forcing the electronic card outwardly when the rocking member is actuated by the manually-operated bar; and retaining means for retaining the rocking member on the shielding member comprising a retaining tab formed on a free end of the pivot and an opening defined in the rocking member, the retaining tab being unsymmetrical about the center of the pivot and having a maximum dimension in a predetermined direction, the opening having a first length and a second length smaller than the first length, the opening receiving the retaining tab with the first length of the opening corresponding to the maximum dimension of the retaining tab when the rocking member is at a first angular position with respect to the shielding member, the maximum dimension of the retaining tab engaging with an edge of the opening associated with the second length thereof when the rocking member is at a second angular position.

2. The electronic card connector as claimed in claim 1, wherein the second angular position is substantially normal to the first angular position.

3. The electronic card connector as claimed in claim 1, wherein the retaining tab is elongate in the first direction with the maximum dimension extending in the first direction, the retaining tab having a minimum dimension in a second direction substantially normal to the first direction.

4. The electronic card connector as claimed in claim 3, wherein the retaining tab has an elliptical shape.

5. The electronic card connector as claimed in claim 4, wherein the pivot comprises two arcuate projections formed on the shielding member co-axial with the center of the pivot, the retaining tab comprising a crescent flange formed on each arcuate projection forming a portion of the elliptical shape.

6. The electronic card connector as claimed in claim 1, wherein the opening of the rocking member is rectangular.

7. The electronic card connector as claimed in claim 1, wherein two arcuate slots are defined in the shielding member co-axial with the center of the pivot for guidingly receiving two pins extending from the rocking member to guide the rotation of the rocking member about the pivot.

8. The electronic card connector as claimed in claim 1, wherein a card engaging tab is formed on the second end of the rocking member, the card engaging tab being located between the arms of the header and receivable in a recess defined in the central section of the header when the manually-operated bar is not actuated thereby not interfering with insertion of the electronic card into the space between the arms.

9. The electronic card connector as claimed in claim 1, wherein a second shielding member is attached to a second face of the central section of the header.

10. The electronic card connector as claimed in claim 1, wherein the manually-operated bar defines a recess in an end thereof for receiving and engaging with the first end of the rocking member.

11. The electronic card connector as claimed in claim 1, wherein a guide rail is attached to each of the arms of the header for guiding the electronic card into the space between the arms.

12. The electronic card connector as claimed in claim 11, wherein the manually-operated bar is movably attached to one of the guide rails.

13. A card release mechanism comprising:

a shielding member adapted to be fixed to a header of a card connector;

a rocking member rotatably positioned on the shielding member;

a support device for guidably retaining the rocking member to the shielding member, comprising projections extending upwardly from the shielding member with at least one flange horizontally extending at a distal end of one corresponding projection, said flange generally extending along a predetermined direction; and an opening defined in the rocking member, forming a first dimension and a second dimension smaller than the first dimension along different directions; wherein the rocking member is assembled to the shielding member with the first dimension disposed along said predetermined direction so as to have the opening receive the support device therein for initial assembling without interference with the flange, and rotated at an angle to a final operation position with the second dimension disposed along said predetermined direction so as to have the rocking member engage with the flange in an upward direction to prevent removal of the rocking member.

* * * * *